US007165428B2

(12) United States Patent
Isaacs et al.

(10) Patent No.: US 7,165,428 B2
(45) Date of Patent: Jan. 23, 2007

(54) LOCK

(75) Inventors: Frederick Bertram Isaacs, High Wycombe (GB); Paul Nicholas Roger Michael Isaacs, Woodburn Green (GB)

(73) Assignee: ISON Limited, Buckinghamshire (GB)

( * ) Notice: Subject to any disclaimer, the term of this patent is extended or adjusted under 35 U.S.C. 154(b) by 234 days.

(21) Appl. No.: 10/502,424

(22) PCT Filed: Jan. 27, 2003

(86) PCT No.: PCT/GB03/00333

§ 371 (c)(1),
(2), (4) Date: Jul. 23, 2004

(87) PCT Pub. No.: WO03/062571

PCT Pub. Date: Jul. 31, 2003

(65) Prior Publication Data

US 2005/0081582 A1 Apr. 21, 2005

(30) Foreign Application Priority Data

Jan. 26, 2002 (GB) ..... 0201867.9

(51) Int. Cl.
*E05B 49/02* (2006.01)
*E05B 47/00* (2006.01)

(52) U.S. Cl. ..... 70/278.1; 70/257; 70/279.1

(58) Field of Classification Search ..... 70/257, 70/275, 277, 278.1, 278.2, 278.3, 279.1
See application file for complete search history.

(56) References Cited

U.S. PATENT DOCUMENTS

| | | | | |
|---|---|---|---|---|
| 3,733,861 | A | 5/1973 | Lester | |
| 4,656,850 | A | 4/1987 | Tabata | |
| 4,833,465 | A * | 5/1989 | Abend et al. | 70/279.1 |
| 4,995,248 | A * | 2/1991 | Liu | 70/277 |
| 5,377,513 | A * | 1/1995 | Miyamoto et al. | 70/277 |
| 5,791,179 | A * | 8/1998 | Brask | 70/278.1 |
| 6,418,763 | B1 * | 7/2002 | Huang | 70/279.1 |
| 6,539,755 | B1 * | 4/2003 | Bruwer et al. | 70/279.1 |

FOREIGN PATENT DOCUMENTS

| | | |
|---|---|---|
| DE | 196 49 444 A1 | 7/1998 |
| WO | WO 00/26489 | 5/2000 |

OTHER PUBLICATIONS

International Search Report of PCT/GB2003/00333, dated Jun. 16, 2003.

* cited by examiner

*Primary Examiner*—Suzanne Dino Barrett
*Assistant Examiner*—Christopher Boswell
(74) *Attorney, Agent, or Firm*—Christie, Parker & Hale LLP

(57) ABSTRACT

A lock (1) comprises an electronics module (6) which in response to receiving an authorisation signal from an electronic key (8) causes movement of handles (4*a;* 4*b*) to release a bolt (19) within aperture (3). Electronic module (6) is replaceable and is retained in place by a latch (16) that may be released by actuation of a mechanical lock (11).

19 Claims, 13 Drawing Sheets

LOCK

CROSS-REFERENCE TO RELATED APPLICATION

This application is a National Phase Patent Application of International Application Number PCT/GB03/00333, filed on Jan. 27, 2003, which claims priority of British Patent Application Number 0201867.9, filed on Jan. 26, 2002.

The present invention relates to a lock and in particular, but not exclusively, to a lock suitable for remote applications, applications where a number of authorised individuals need to be able to open the lock and where it may subsequently be necessary to seek authorisation from selected individuals without the requirement to obtain the return of a key associated with the lock.

The present inventors have identified that there is a need for a lock that is robust, can be operated by a number of individuals and which Is intelligent. "Intelligent" in the sense used herein means that the lock should be able to communicate information relating to an associated key, thus possibly identifying the key operating the lock, and/or identifying different keys and controlling access in dependence on the key used and the logic programmed into the lock. The term "key" encompasses any device which has to be presented to the lock to operate it, particularly the term encompasses electronic programmable cards, sometimes referred to as "smart cards" and tokens or tags, the latter possibly being in the form of a key fob for a key ring. Such keys can communicate by wireless means for example infrared emissions, radio waves or by inductive coupling.

OUTLINE OF THE PRESENT INVENTION

According to the present invention there is provided a lock comprising: a secure housing having a first portion containing mechanical components of the lock; a second portion for receiving an electronics module; and handles mounted externally with respect to the secure housing. The electronics module comprises a power supply; electronics circuitry including an antenna and wireless transceiver circuitry capable of receiving an authorisation signal from an electronic key which is brought into dose proximity to the electronics module; and a motorised actuator responsive to an authorisation signal.

The mechanical components in the first portion of the housing comprise a retaining pin which acts as a deadbolt for releasably retaining a robust bolt in position in the lock and in addition a linkage mechanism providing means for the handles under selective circumstances to be connected to the retaining pin such that movement of the handles displaces the retaining pin, appropriate selective circumstances being when an authorisation signal has been received by the transceiver circuitry of the electronics module whereby the motorised actuator interacts with the linkage mechanism so as to permit movement of the handles to displace the retaining pin.

A lock according to the invention is particularly advantageous In a remote or hostile environment. Considering for example a location for a mobile radio mast, such a site will typically comprise a perimeter fence enclosing apparatus belonging to several companies. In such an application operatives of the respective companies will need access to the site. In addition, it may also be necessary to occasionally provide access to contractors charged with the performance of specific tasks within the site. Employing the present invention enables a common lock to be provided with any number of keys issued, each key may conveniently be in the in the form of an electronic card or tag issued to appropriate personnel. Each key, or group of keys, may have a unique code and the lock can be arranged, by programming of the electronics module, to permit selective operation of the lock depending on information encoded into the signal from the key.

The function and advantages of electronic or intelligent locks, are already known, most of which would be applicable to a lock In accordance with the present invention. These are too numerous to list here, but by way of Illustration, the lock may, for example, be programmed, either by transmitting a signal to it on site, or by programming the electronic module off site, such that it may recognise only certain cards issued as being authorised, such as cards belonging to one company. Alternatively, the lock may be programmed to permit access only at certain times.

A particular advantage of having an electronic module which can be removed from the lock is that if a module needs to be reprogrammed or replaced for some reason, for example the power supply contained within that module is failing, (which power supply will normally be in the form of battery contained within the module), then the module may be arranged in the form of a secured and selectively releasable cartridge so that it can be replaced simply without removing or dismantling the lock.

A problem with an electronic lock for a remote application is that, taking the example of a perimeter fence, the lock may be remote from a power source and may be visited infrequently, thus the useful lifetime of the module will often depend on the requirement for electronic power from a power supply contained within the module. The present invention uses very little power producing only a minimal drain on the power supply of the electronic module by having a mechanism whereby it is the action of the handle that physically withdraws the retaining pin, the electronics module only enabling the release of the retaining pin.

Preferably the lock further comprises mechanical locking components which inter alia cooperate to releasably secure the electronics module within the secure housing, releasing means being in the form of a mechanical key. This mechanical key-operated lock arrangement enables, by means of turning the key In the lock In a first direction, the electronics module to be replaced, even after it has failed, but it is Important to note that access to this electronic module release function is restricted.

It is also particularly advantageous if the same mechanical key, by virtue of being turned in a second direction In the lock, can release the retaining pin from the bolt thereby providing means to perform manual override locking and unlocking operations since these functions would also be necessary in the event of failure of the electronics module.

Further advantages may be conferred by arranging that the key-operated lock Is arranged to receive a first key type, which can only turn in one direction and a second key type which can turn in the other direction or both directions, for at Is then possible to have a first mechanical key type which can override the lock in the event of a failure of the electronic module and another key type which can permit both mechanical override of the locking and unlocking function and provide releasing means for the electronics module.

Locks according to the present invention may be made in various forms by directing the embodied features according to the requirements of a given environment. For instance, in an urban environment where vandalism is a recurring problem, it is particularly advantageous that the linkage mechanism only provides mechanical linkage between the handles and the retaining pin when an authorisation signal has been received. By virtue of the handles being able to "freewheel" at other times the possibility of extreme force being applied to the handle (which might otherwise damage the locking mechanism) is avoided. This arrangement also further provides the possibility that where the electronic module is normally In a power conserving 'sleep' mode, with its receiver turned off, it can be awoken by mechanical operation of the handle. This operation of the handle will first awake the electronic module and then, if an authorised electronic key is in close proximity to the receiver of the module, then the actuator of the module may permit force applied to the handle to be transmitted to the retaining pin to withdraw that retaining pin.

Even though the lock of the instant invention is very power-sparing, repeated unauthorised interference by vandals will introduce many cycles of waking the electronics module which will eventually shorten the service life of the battery. This may not be a great problem In an urban environment since maintenance schedules will compensate for any recurring issue of power drainage and the need for electronics module replacement because of battery depletion.

However, a remote environment may be hostile in a different manner in that the site may be difficult to reach or it may be simply infrequently visited. Vandalism is unlikely to be an issue here but the maximum extension of battery life is very important, as is lower power consumption, such that the duty cycle of an electronics module between changes is as long as possible. To accommodate this type of application the interaction between the handles and the retaining pin may be arranged such that only 90° of free motion of the handles is provided upon first approach, the handles springing back to the start position when released, and a magnetic switching arrangement between the electronics module and mechanical lock manages the operation of the lock.

In either form, in addition to an authorisation being necessary to permit opening of the lock, it is advantageous if on exit or if a lock-in is required, that the electronics module and mechanical components are arranged such that an authorisation signal also has to be received to permit the bolt and the retaining pin to cooperate so as to close and secure the lock. This may be accomplished by providing the electronics module with a sensor for detecting the presence of the bolt. These features provide for the identification of the key which authorised operation of the lock and thus permit the lock to both record when the lock was opened and when it was subsequently closed, thus the electronics module of the present invention is able to store an audit trail.

Further variations may combine the lock of the instant invention with one or more wireless or other communications technologies. Such applications are important, not only for commercial reasons but also because they may assist organisations to meet existing and incoming Health and Safety Regulations. Such regulations have been in force in the UK since 1974 and the Management of Health and Safety at Work (MHSW) Regulations 1999 updated the position regarding the Lone Worker. Many other countries and the European Community have stringent policies concerning the safety of the Lone Worker.

By way of example only, the lock of the present Invention may be deployed at a remote mobile telephone repeater station and be provided with a Bluetooth™ enabled device operating in the 2.4 GHz band over about 10 metres or so at an extremely low power level and which would wake up only when the lock was activated. This device could communicate with another Bluetooth™ device located in the station compound which in turn could interface with, say VHF technology, to send and receive data over moderate to large distances. By these or other wireless technologies the whereabouts of employees at precise times could be established and check-in protocols would ensure that their safety status was updated regularly. In addition, many other functions could be controlled via the medium of the instant lock, including controlling variations to levels of clearance for access to sites. For instance, one worker may be entitled to access certain sites of a company or government department but not others. If a colleague failed to report for work due to illness and a replacement for his or her duties was needed urgently at a remote point, the lock at that site could be remotely programmed via a communications link such as the example immediately hereinbefore described with an updated and temporary elevation of security clearance for the replacement operative not normally able to gain access to the site. Numerous other communications protocols might be used instead including GPRS and WAP devices.

Advantageously, a dummy electronics module may be mechanically configured such that, when inserted into the second portion of the secure housing of the lock, it interacts physically with the mechanical components to allow release of the lock mechanically, thus permitting the lock to be placed in a permanent manual override position until the dummy module is replaced with a functioning electronics module.

According to a second aspect of the present invention, there is provided a non-contact key for use with the lock which may be in the form of a "smart card" or a token or a key fob attachment in the form of a tag, in every case the key being provided with electronic circuitry means which identify its bearer to the lock with the intent of providing access only to those with appropriate permissions.

Two preferred embodiments of the present invention will now be described with reference to the accompanying figures, in which corresponding numeral series are used throughout to indicate like parts and of which:

FIGS. 1*a* and 1*b* are perspective exterior views of the front and rear aspects, respectively, of a lock in accordance with two preferred embodiments of the present invention and including a view of a "smart card" key;

FIGS. 1*c* and 1*d* are perspective details of the front and rear aspects, respectively, of handles of the second of the two preferred embodiments mounted on a cut away portion of a security plate and secure housing as illustrated in FIGS. 1*a* and 1*b* and included to show means for providing a spring-back feature when handles are released;

Referring first to FIGS. 1*a*, 1*b* and 2 through 7 there is shown a first preferred embodiment of a lock, according to the present invention, numbered generally as 1 and which is primarily intended to be used in applications and situations where the risk of vandalism or other deliberate damage is high and where battery longevity, though excellent, is slightly less than in the second embodiment hereinafter described.

Figure 1A:
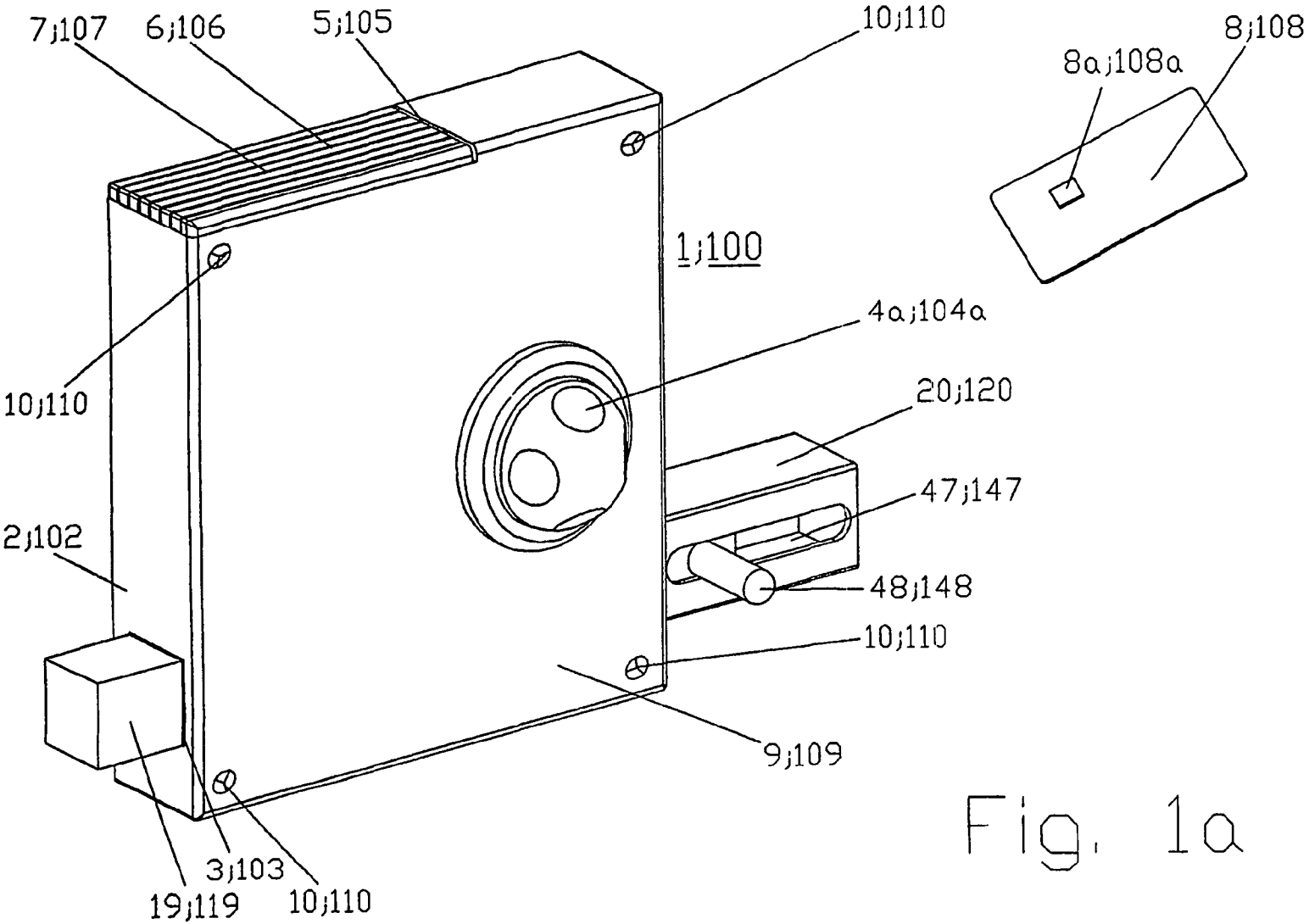
Figure 1B:
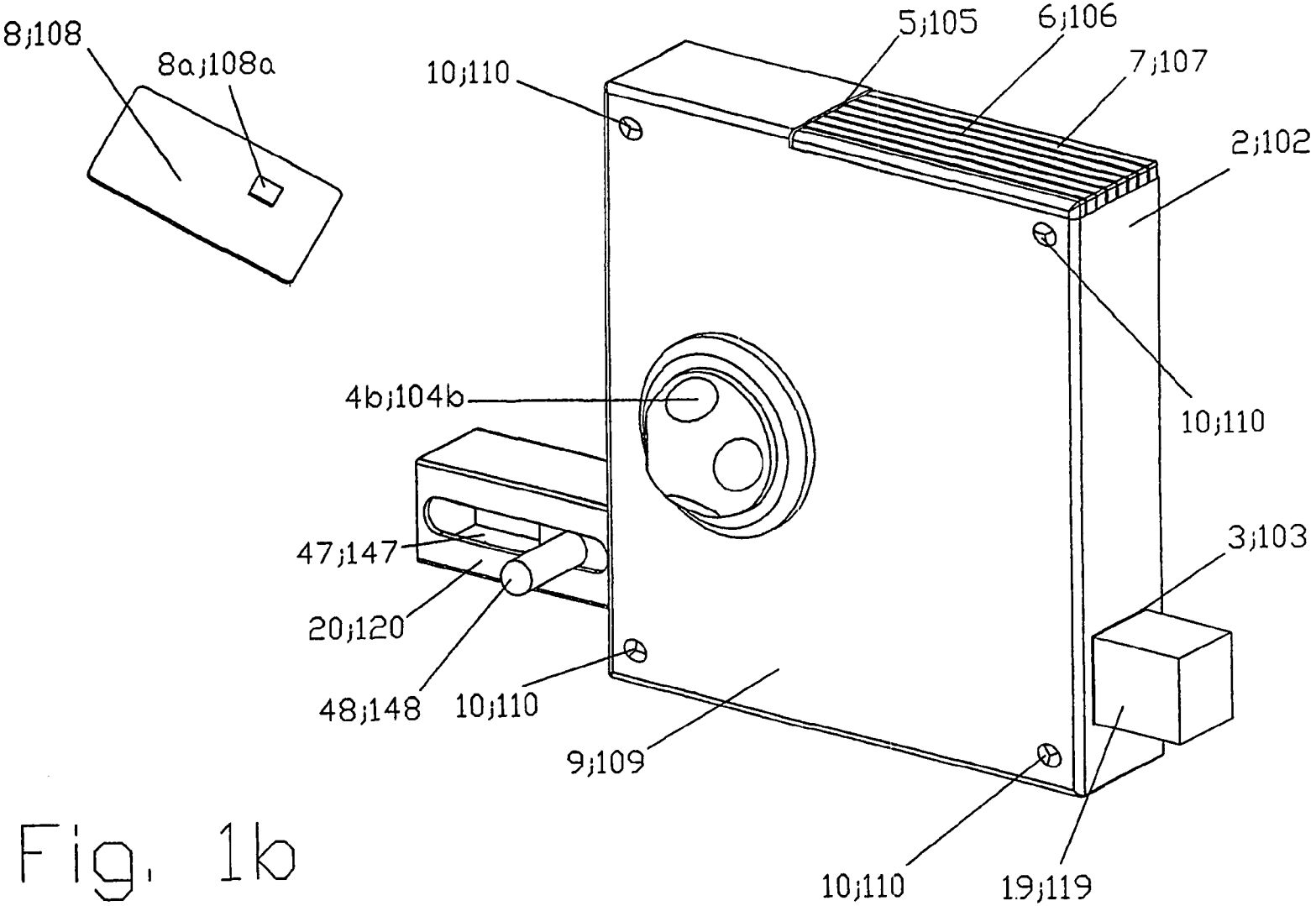

In FIGS. 1*a* and 1*b* a lock, shown generally as 1 comprises a housing 2 a first aperture 3 for receiving an integral bolt 19 handles 4*a* and 4*b* for actuating lock 1 and a second aperture 5 for receiving an electronics module 6. Electronics module 6 has an antenna within casing 31 the position of which is indicated at 7. Antenna 7 is for communicating with a non-contact electronic key preferably in the form of 'smart card' 8 having microcircuitry indicated at 8*a* embedded therein for communicating with electronics module 6 by bringing it into close proximity thereto.

Lock 1, is preferably constructed of stainless steel and optionally comprises an additional stainless steel plate which functions as a security cover 9 secured in place by a plurality of security screws 10. Screws 10 may be any suitable commercial off-the-shelf screws having a head that requires a special tool to release them. Security cover plate 9 obscures the position of a mechanical cylinder lock 11 the function of which is described hereinafter and therefore security cover plate 9 hides a potential 'soft spot' of lock 1. For additional security, steel cover plate 9 may be secured from within housing 2 using screws 10 only on the inward facing or locked area facing of lock 1. For the absence of doubt it is to be understood that the intention is to place screws facing into a locked area which the lock is securing and to present a plain cover to the outside.

Figure 2:
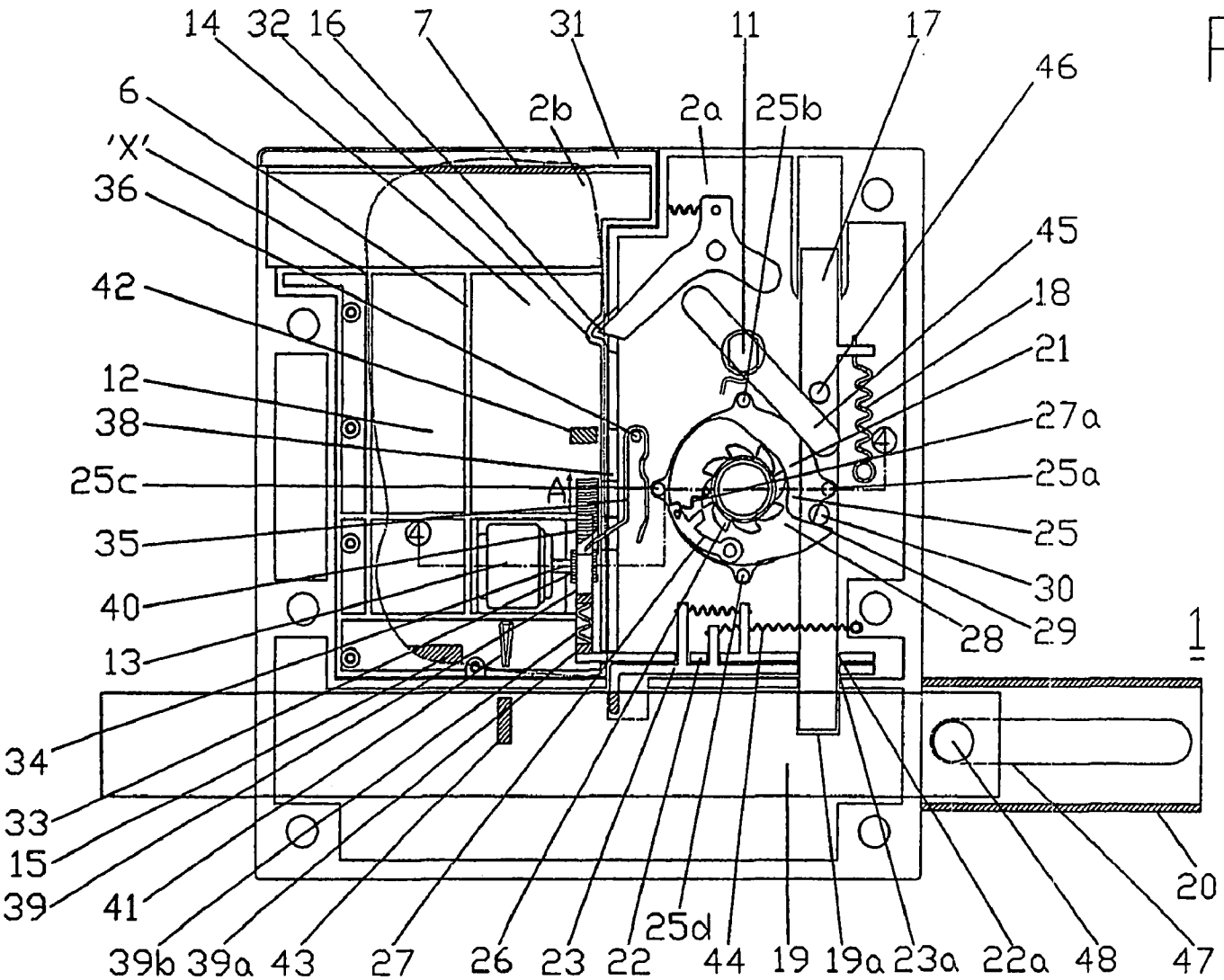
FIG. 2 is a front elevation of the first preferred embodiment of the lock of FIGS. 1*a* and 1*b* in a locked condition with a security cover and the front secure lock housing removed and the casing of an electronics module partially cut away to reveal internal components.

Referring to the elevation of FIG. 2 this shows lock 1 with security cover plate 9 and the front of housing 2 removed and casing 31 of electronics module 6 partially cut-away along double-dash-triple-dot line 'X'. Housing 2 comprises a first portion 2*a* having mechanical components housed therein and a second portion 2*b* in which electronics module 6 is located.

Figure 5:
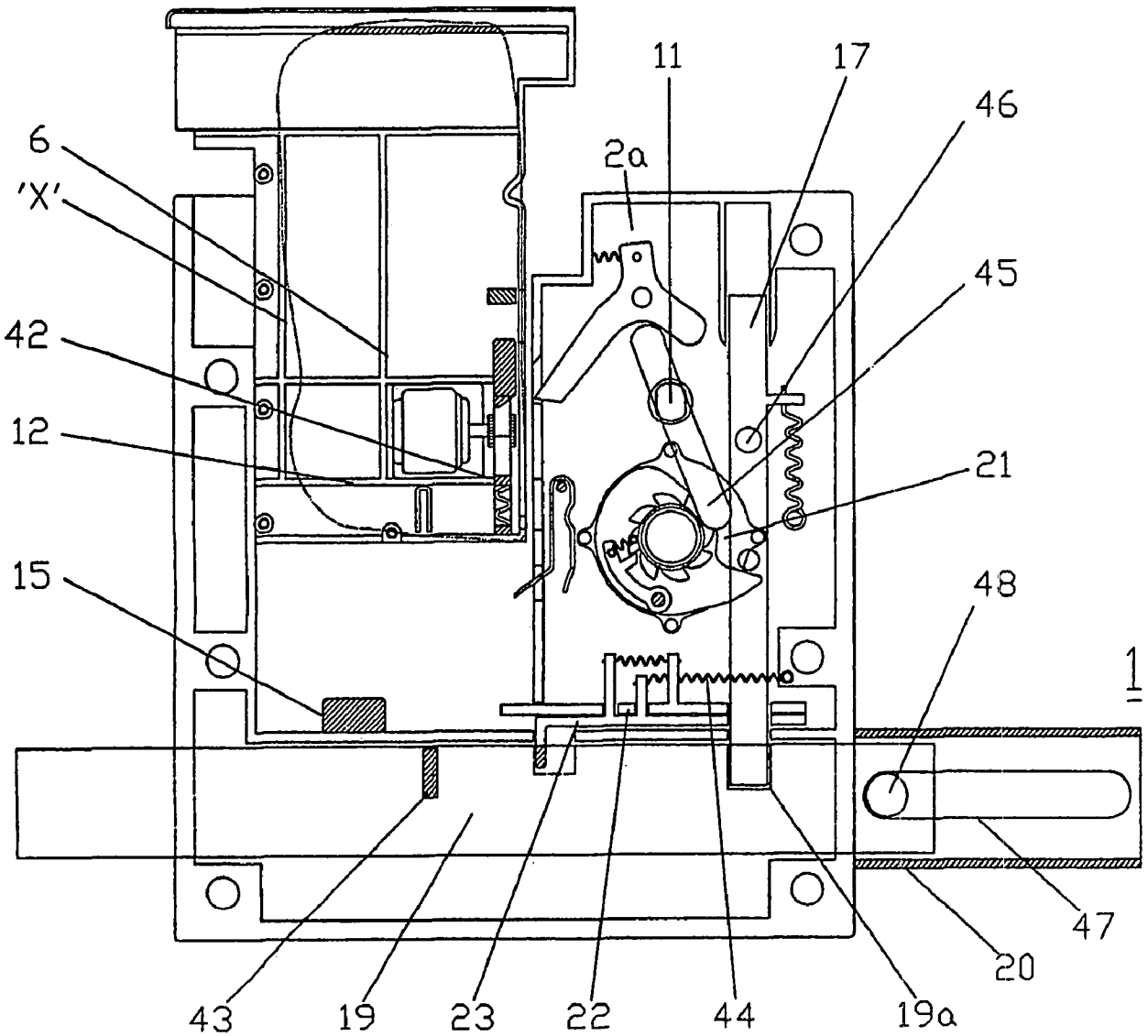
FIG. 5 shows a front elevation of the lock of the first preferred embodiment of FIGS. 1*a* and 1*b* in a locked condition with a security cover and the front lock housing removed and the casing of an electronics module partially lifted out.
Figure 7:
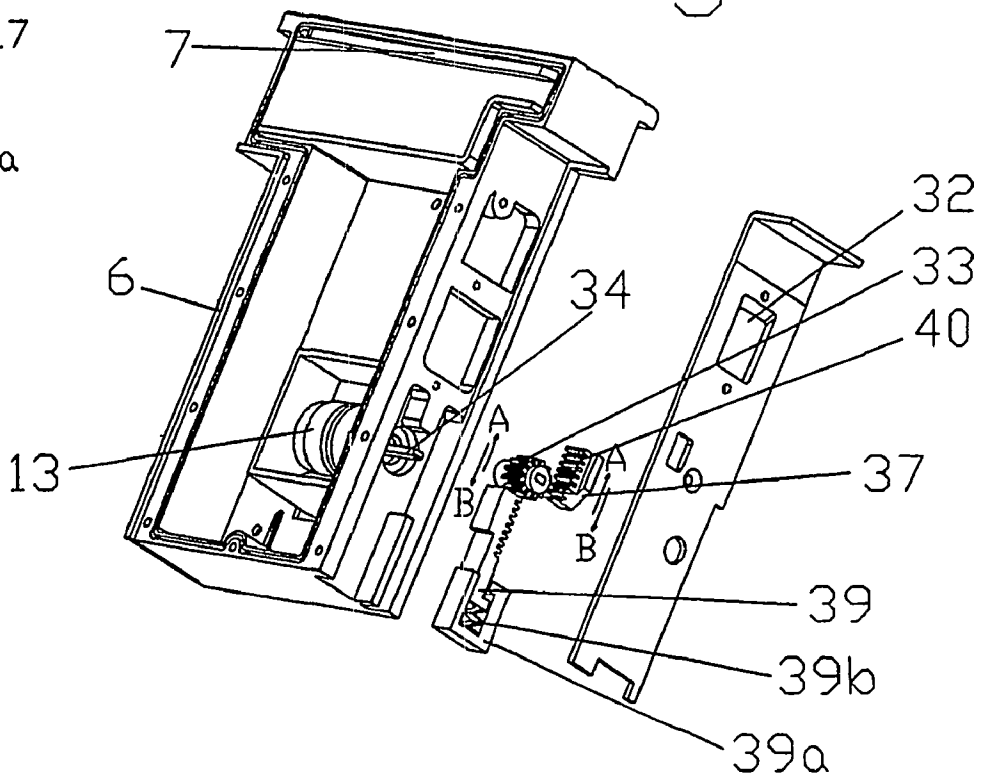
FIG. 7 is a partially exploded perspective view of an electronics module illustrating important components common to both preferred embodiments of the lock of the present invention.

Electronics module 6 may be seen in more detail by brief reference to FIGS. 5 and 7. Electronics module 6 houses a substantial battery pack 12 which may be of any convenient type having the properties of longevity and robust reliability, a motorised actuator 13 and modular circuitry which may conveniently be a PIC or ASIC package 14 having antenna, transceiving, optional separate communications circuitry, encoding, decoding and control elements. Electronics module 6 is retained within housing 2 against resilient block 15 by latch 16 engaging recess 32.

The mechanical components of lock 1 in first portion 2*a* of housing 2 comprise a bolt-retaining pin 17 biased by spring 18 to the engaged position within deadlock recess 19*a* shown in FIG. 2 whereby it retains bolt 19 In the extended, locked position of lock 1. Bolt 19 locates and travels in not only housing 2 but also in housing extension 20. Housing extension 20 has a slot 47 and bolt 19 has an operating pin 48 extending completely through bolt 19 and extending out through slot 47. Under appropriate conditions this enables an operative to manually throw bolt 19 from a retracted position, within lock 1 to an extended position, by moving operating pin 48 along the full extent of slot 47 of housing extension 20. Extended bolt 19 may engage a recess in the same manner as a mortise lock, and vice versa. However, although in this embodiment this arrangement is preferred, it will be apparent to those skilled in the art that bolt 19 may be arranged in many different ways. For instance, housing extension 20 could be omitted and slot 47 could be accommodated directly in secure housing 2 though with some loss of vandal-proofing.

The other principal components are comprised in a linkage mechanism illustrated generally as 21 and described hereinafter with reference to FIGS. 2 to 7. In addition, there are two latching slides 22 and 23 each being provided with clearance openings 22*a* and 23*a* respectively. The function of clearance openings 22*a* and 23*a* is to allow retaining pin 17 to pass through into deadlock recess 19*a* of bolt 19 when aligned therewith such as occurs when lock 1 is desired, and duly authorised, to be locked dosed or unlocked. At other times, latching slides 22 and 23 present solid metal under retaining pin 17 which thus cannot then pass through into deadlock recess 19*a*.

Figure 6:
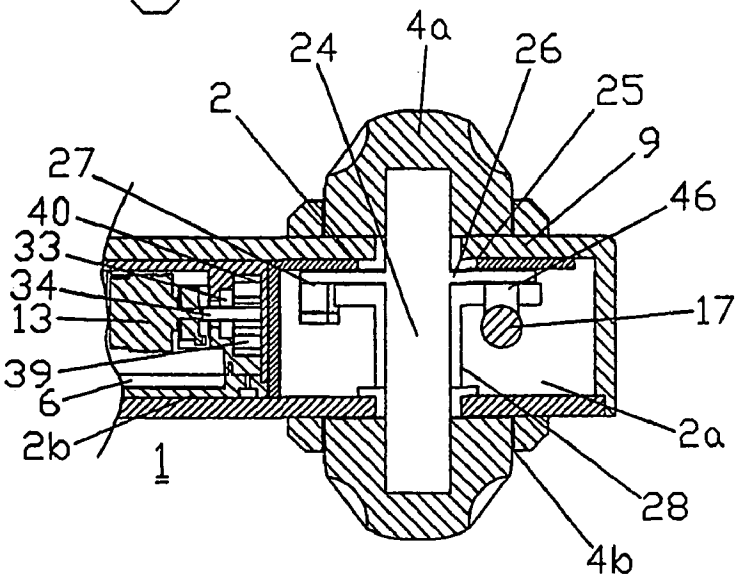
FIG. 6 shows a section along the line '4—4' of FIG. 2.

Referring to FIG. 6 which is a sectional view along line '4—4' of FIG. 2, this shows some important aspects of the linkage mechanism 21 especially the manner in which it is supported by shaft 24 extending between handles 4*a* and 4*b* located on either side of housing 2. As may be best seen in FIGS. 2, 3, 4 and 5 linkage mechanism 21 comprises a paddle wheel 25 and dog clutch 26 engageable by pawl 27. Paddle wheel 25 and dog clutch 26 are physically connected to handles 4*a* and 4*b*. Linkage mechanism 21 additionally comprises a bushed driven plate 28 to which pawl 27 is attached. Bushed driven plate 28 has an engagement surface 29 for contacting pin 30 extending from retaining pin 17 as may be seen, for instance, by brief reference to FIGS. 2 and 3.

Referring now to FIG. 7 motorised actuator 13 is located in electronic module 6 which also has a recess 32 in casing 31 by means of which it is retained in position via latch 16. Motorised actuator 13 has a shaft 34 providing mounting means for gear 33 which acts on opposing racks 39 and 40 in the direction of arrows 'A' and 'B'. As may be seen by reference to FIG. 7 rack 39 has a captive guide 39*a* provided with a buffer spring 39*b*. These elements cooperate to interact with slide 22 whilst rack 40 has a driving face 37 which Interacts with spring 35 which is pivoted on pin 36 to selectively drive pawl 27 against captive pawl spring 27*a*. Captive pawl spring 27*a* maintains a biasing force against pawl 27 tending to disengage It from dog clutch 26 and this condition prevails until passing contact with spring 35 overcomes the effect of spring 27*a*.

Electronic module 6 additionally comprises two sensors 41 and 42. First sensor 41 is a reed switch and detects the presence of magnet 43 located on bolt 19 when it is thrown fully home locking lock 1. Sensor 42 is a sensor that detects movement of paddle wheel 25 by detecting the movement of magnets 25*a* to 25*d* retained in paddle wheel 25 as they pass window 38 in housing 2.

Describing now the operation of the first preferred embodiment of the instant lock, lock 1 is installed on a gate or door or the like, that it is desired be secured. Lock 1 is installed in a position such that bolt 19 can be received slidably into a suitable locking aperture. Authorised personnel on approaching lock 1 rotate handle 4*a,* and simultaneously present a key in the form of an electronic smart card or tag 8 to lock 1 so that it is in close proximity to antenna 7 of electronic module 6.

As may be seen variously from FIGS. 2 through 6 rotation of handle 4*a,* will cause paddle wheel 25, to rotate and magnets 25*a* to 25*a* to pass by sensor 42 which detects the movement and sends signals to circuitry package 14 within electronics module 6 to "wake up" sits integral transceiver. At this stage, handles 4*a* and 4*b* are is free to rotate, there being no connection between bushed driven plate 28 and handles 4*a* and 4*b*.

In response to transceiver element of 14 receiving an authorisation signal from key 8 via antenna 7 control circuit element of electronic package 14 controls motorised actuator 13 to drive rack 40 of FIG. 7. As may be seen with reference to FIG. 2 driving face 37 of rack 40 makes driving contact with spring 35 which is driven into contact with pawl 27 overcoming the disengagement bias of captive pawl spring 27*a* and causing engagement of pawl 27 with dog clutch 26. When pawl 27 engages dog clutch 26 further rotation of handle 4 causes retaining pin 17 to be withdrawn from bolt 19 until i is in the raised position shown in FIG. 3.

Figure 3:
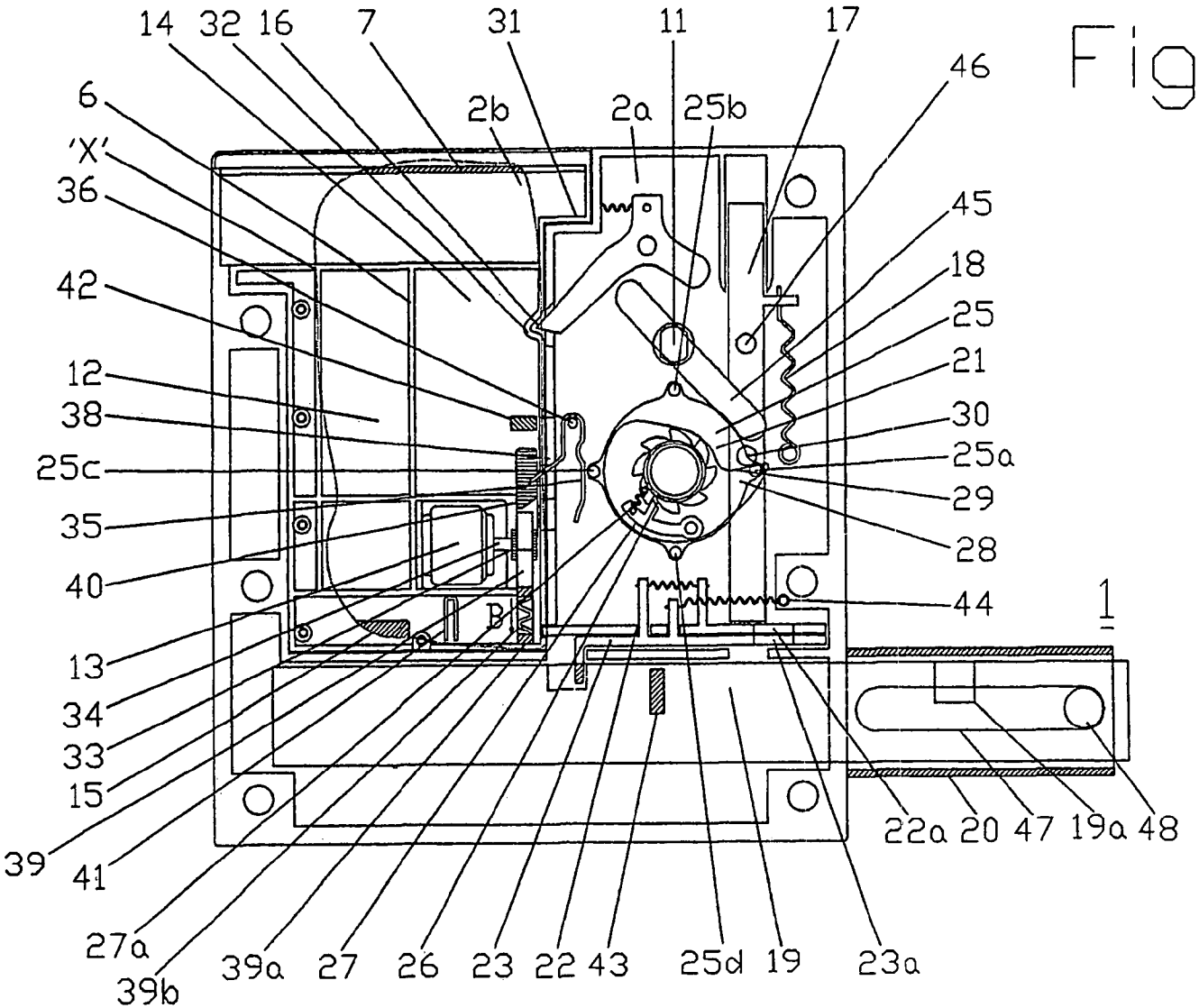
FIG. 3 shows a similar view to FIG. 2 but with the lock of the first preferred embodiment latched open.
Figure 4:
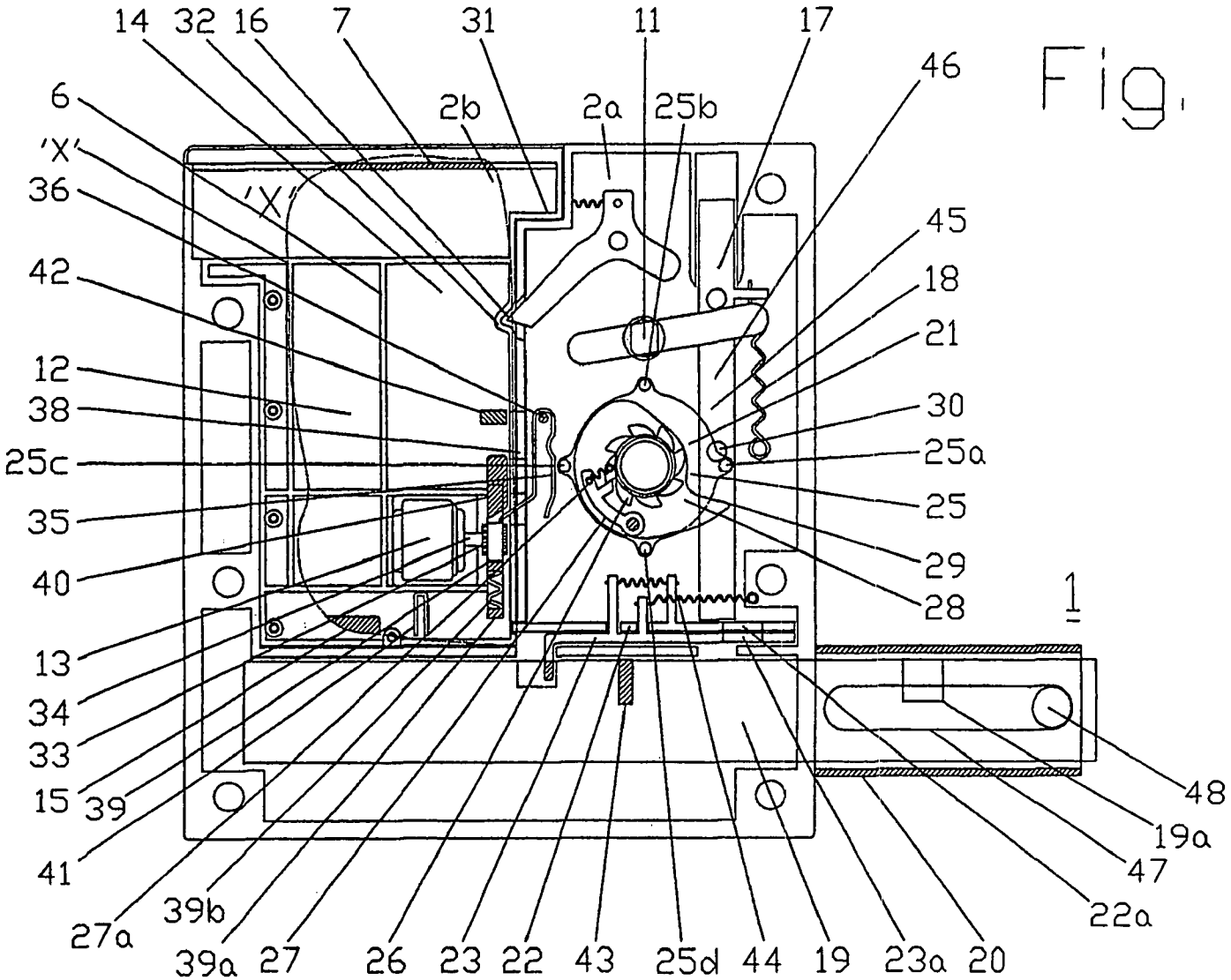
FIG. 4 shows a similar view to FIG. 3 with the lock of the first preferred embodiment latched open, in this view the lock is in mechanical override mode.

With continuing reference to FIG. 3 when retaining pin 17 is withdrawn, lock 1 is in a condition for bolt 19 to be thrown into extension. Retaining pin 17 has been raised through clearance openings 22*a* and 23*a* and is latched into the raised position by slides 22 and 23 which are urged into the positions shown by the action of spring 44.

When lock 1 is in the open position (FIG. 3), and it Is desired to re-lock lock 1 an authorised operative "wakes up" the transceiver circuitry of electronics package 14 of electronic module 6 by the mechanical operation of 4*a* and 4*b* which action presents magnets 25*a* to 25*a* to sensor 42. If transceiver circuitry of 14 detects the presence of an authorised key 8 it then sends a signal causing motorised actuator 13 to move racks 39 and 40 in the direction of arrow 'A' of FIG. 2. When bolt 19 is extended from aperture 3 the movement displaces slide 23 and subsequently slide 22 permitting retaining pin 17 to drop through clearance openings 22*a* and 23*a* which are aligned thereunder and engage bolt deadbolt recess of bolt 19. It is to be noted that if an authorisation signal has not been received, then rack 39 will still be In the position indicated by arrow 'B' in FIG. 3. Slide 22 will thus be prevented from moving in a direction to the left of FIGS. 2 or 3 and thus clearance openings 22*a* and 23*a* will not be aligned with retaining pin 17 which therefore will not drop and engage bolt 19.

Circuitry within package 14 of electronic module 6 logs both the opening and closing of lock 1 identifying both the time and the identity of the card key 8 that caused lock 1 to be opened or closed. In addition, circuitry within electronics package 14 of electronic module 6 could also log mechanical functions.

If electronic module 6 should fail, or it Is desired to replace electronic module 6 security cover plate 9 is removed and a mechanical key (not illustrated) is inserted Into mechanical lock 11. Rotation of a mechanical key in a first direction causes locking bar 45 to engage latch 16 releasing it from recess 32 in electronic module 6. Rotation of the mechanical key anticlockwise, causes locking bar 45 to act against pin 46 as may be best seen in FIG. 4, withdrawing retaining pin 17 from bolt 19 and thereby releasing bolt 19.

When it is desired or necessary for maintenance or management purposes to remove electronic module 6 a dummy replacement module (not illustrated) containing no electronics, may be placed in portion 2*b* of housing 2 of lock 1. Such a dummy module would have an appropriate driving face, structurally equivalent to 37 to engage with pawl 27 but not slide 22. This allows lock 1 to operate manually without the need to operate manual cylinder lock 11. A variant dummy module can also be provided which does not have a driving face and which also is not provided with means to engage slide 22. This module would place lock 1 into a key-operated mode.

Referring now to FIGS. 1*a*–1*d* and 7 through 12 there is shown a second preferred embodiment of a lock according to the present invention, numbered generally as 100 and which is primarily intended to be used in applications and situations where the risk of vandalism or other deliberate damage is relatively low but where isolation and climatic hostility demand the greatest possible battery longevity.

In the first preferred embodiment hereinbefore described, handles 4*a;* 4*b* on shaft 24 revolve 360° and this important feature imparts maximal defence against any attempt to destroy the lock by an act of vandalism since, until engaged in drive mode handles 4*a;* 4*b* and shaft 24 'freewheel'. However, in this second preferred embodiment the arrangement of components potentially consumes less battery power, thereby extending the life of the battery and this confers considerable advantages in remote locations and where vandalism is unlikely to be an issue. The only significant differences between the first and second preferred embodiments reside in the mechanical components housed in portion 102*a* of housing 102*a* in comparison to those In portion 2*a* of housing 2 electronics module 106 differing only slightly from electronics module 6.

Figure 1D:
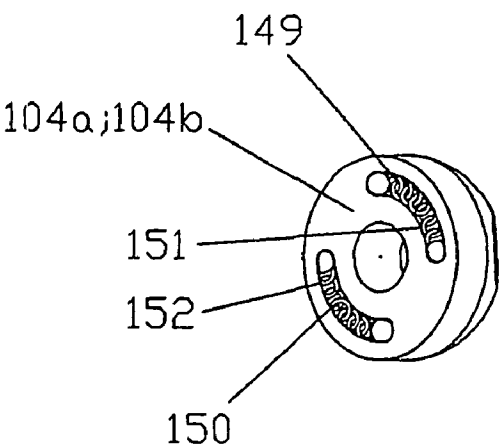
Figure 1C:
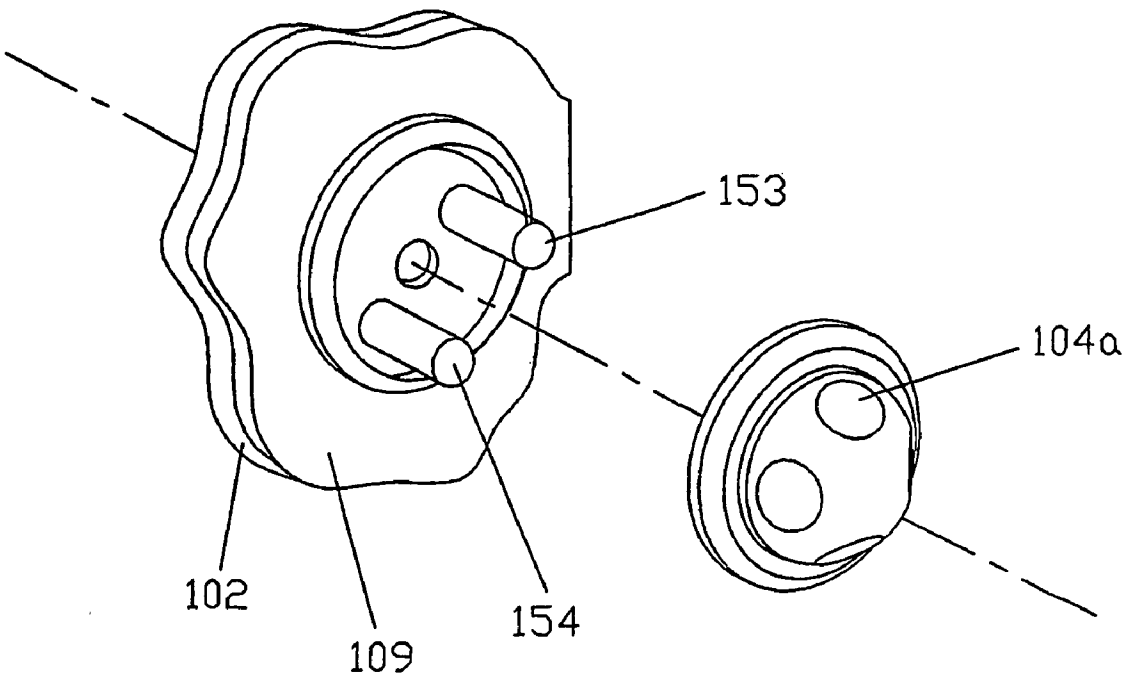

As may be seen with reference to FIGS. 1*c* and 1*d* in this embodiment, handles 104*a;* 104*b,* may be rotationally displaced, with shaft 124 to a limit, in this case, of 90°. Springs 149 and 150 retained in arcuate slots 151 and 152 located in the rear surface of handles 104*a;* 104*b* and disposed symmetrically with respect to the principal axis of shaft 124 cooperate with posts 153 and 154 extending from the face of housing 102. Springs 149 and 150 provide sufficient counter-torque to cause handles 104*a;* 104*b* and shaft 124 when released, to spring back to the original starting or zero position.

With general reference to FIGS. 8 through 12 it may be seen that in this second preferred embodiment there Is provided mechanical lock 111. Mechanical lock 111 is comprised of five major mutually cooperating components directed to two principal purposes. A first component, latch 116 engages with recess 132 directed to the purpose of removably securing electronics module 106 within portion 102*b* of housing 2.

A second component, double crank 155 has a first slide 156 which engages a drive pin 157 mounted high on retaining pin 117 and illustrated in hidden detail. Second slide 158 of double crank 155 engages a pivot pin 159 which also provides pivotal mounting means for a third component, short magnet mounting plate 160 upon which is mounted magnet 161.

A fourth component is magnet swing plate 162 which provides mounting means for another magnet 163 and an extension of it 162*a* may additionally engage a driven pin 164 on a pawl mount 165. The fifth component is locking plate 145 which though more complex in action is analogous to locking bar 45 of the first embodiment.

Figure 8:
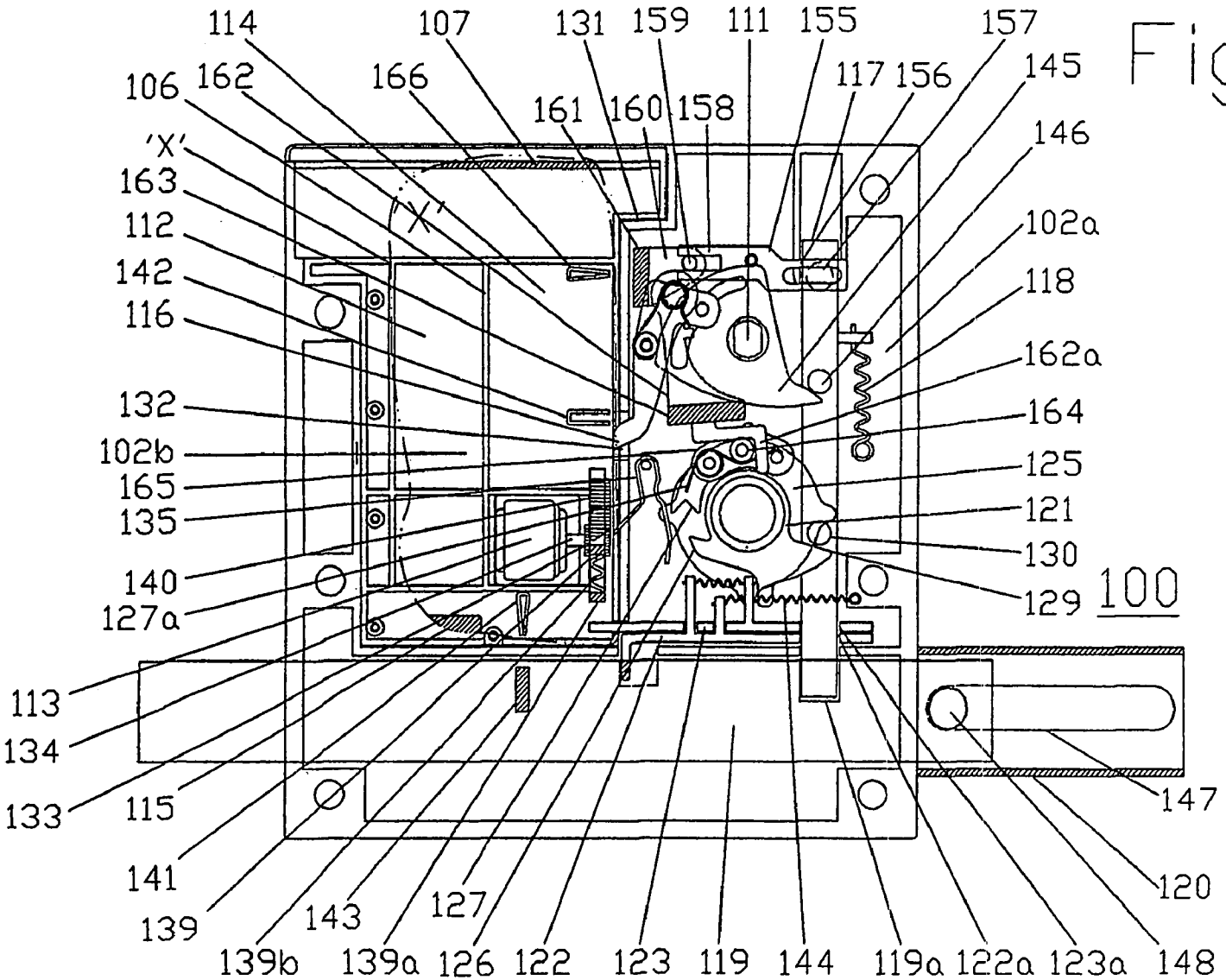
FIG. 8 is a front elevation of the second preferred embodiment of the lock of FIGS. 1*a* and 1*b* in a locked condition, ready to open, with a security cover and the front lock housing removed and the casing of an electronics module partially cut away to reveal internal components.

With particular reference now to FIG. 8 there is shown a lock 100 in accordance with a second embodiment of the present invention, generally similar to the first embodiment in many respects, however pawl 127 is borne on pawl mount 165 and is biased in this embodiment by a captive saddle spring 127*a*. Pawl 127 and dog clutch 126 are effectively reversed in comparison with the first preferred embodiment and these features may be readily compared to their respective counterparts 27 and 26 of the first embodiment by brief reference to, say, FIG. 3. In FIG. 8 it may be seen that bolt 119 is in a locked condition with retaining pin 117 engaged through clearance openings 122*a* and 123*a* into deadlock recess 119*a* and with sensor 141 for sensing bolt status positioned close to magnet 143. Sensor 141 is a reed switch which closes when in proximity to magnet 143. Racks 139 and 140 have been activated such as would be the case just after a smart card 108 had been presented to ready lock 100 for unlocking. If either of handles 104*a* or 104*b* is turned whilst this 'active' condition obtains, pawl 127 will be driven into dog clutch 126 under the influence of spring 135. Spring 135 has a safety function in that its compressibility prevents damage to lock 100 if handles 104*a* or 104*b* are operated abusively.

Figure 10:
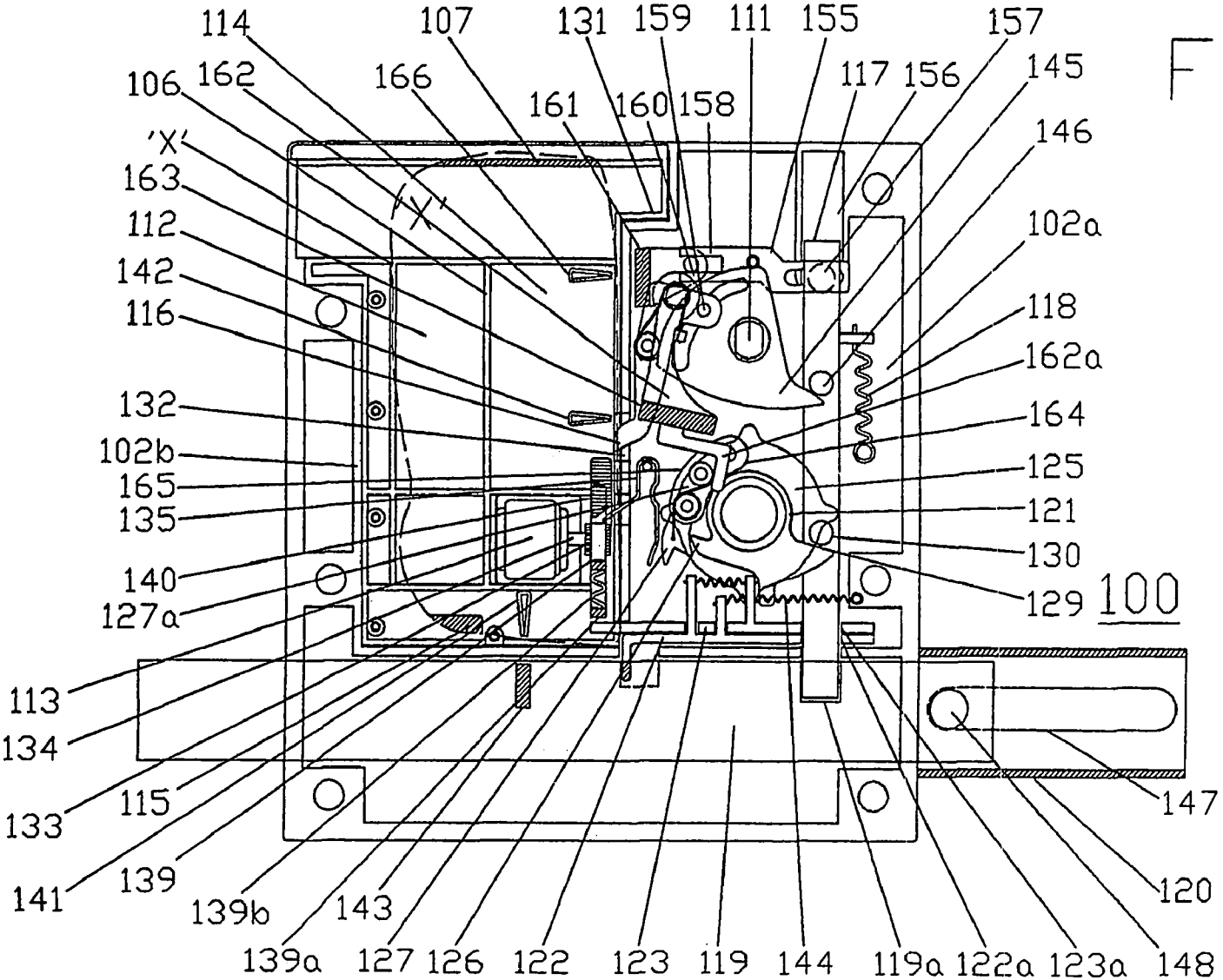
FIG. 10 shows a similar view to FIG. 9 with the lock of the second preferred embodiment locked, in this view the lock is in a "wake up" condition.

FIG. 10 shows a 'wake up' condition. In this embodiment, paddle wheel 125 is connected to shaft 124 and thus connected also to handles 104*a* and 104*b* which are rotated anti-clockwise. This action will cause magnet 163 to close reed switch 142 initiating power supply to the circuitry of electronics package 114 within electronic module 106 producing a brief timed 'on' condition. Pawl 127 at this stage, does not drive dog clutch 126 as rack 140 and spring 135 both remain in a neutral position. In this condition, paddle wheel 125 together with handles 104*a;* 124*b* on shaft 124 will, upon release, spring back to neutral position under the action of springs 149 and 150. In FIG. 10 retaining pin 117 is engaged through clearance openings 122*a* and 123*a* with deadlock recess 119*a* of bolt 119 and this condition also obtains in FIG. 8. It will be noted that when bolt 119 is brought into this condition, drive pin 157 acts upon double crank 155 (causing short magnet mounting plate 160 to swing around pivot 159 so as to bring magnet 161 close to reed switch sensor 166. Raising bolt 119 reverses these actions and it will be appreciated that these components cooperate to provide means for sensing the status of retaining pin 117 to the circuitry of electronics package 114 of electronics module 106. This provision is not made in the first preferred embodiment.

Figure 9:
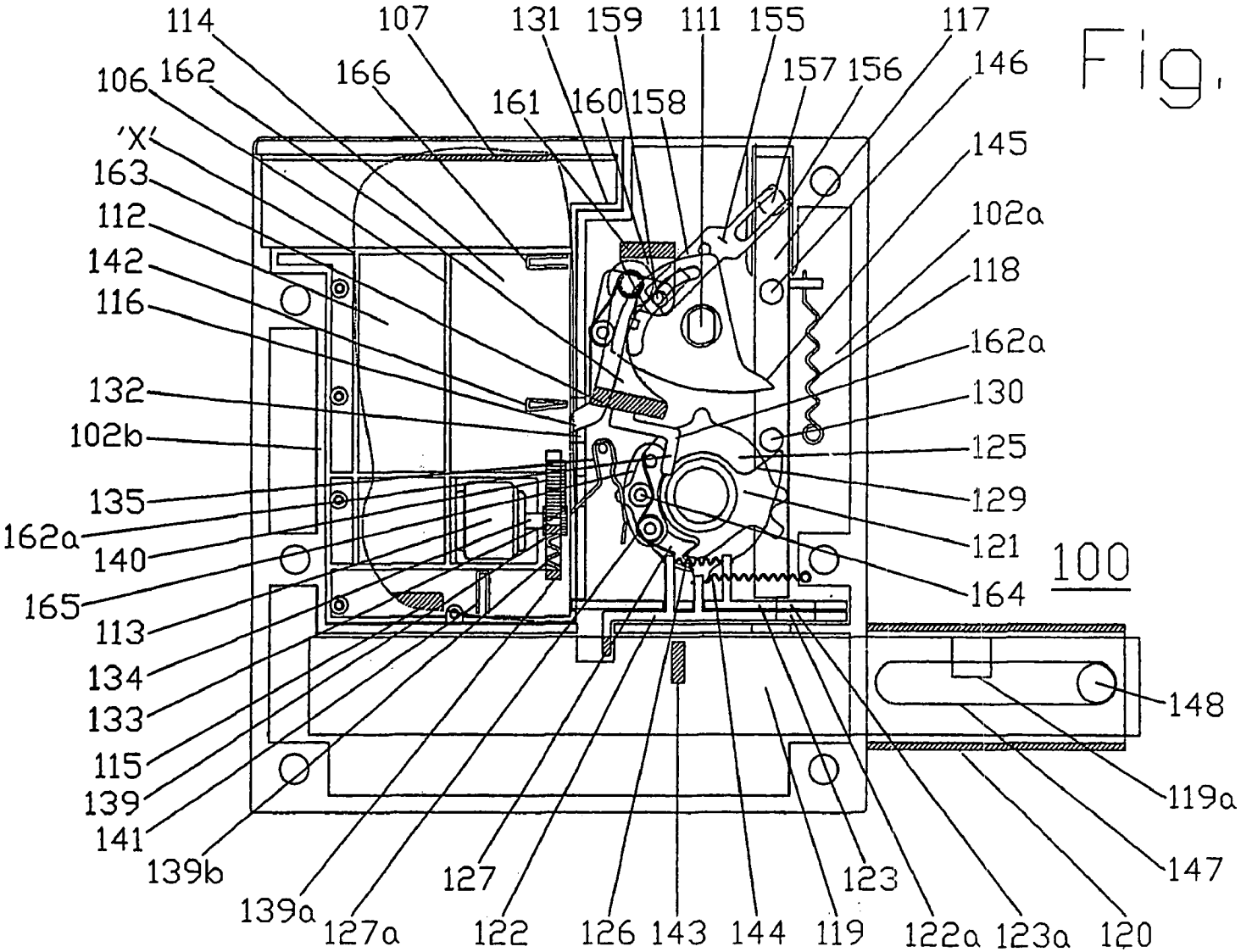
FIG. 9 shows a similar view to FIG. 8 but with the lock of the second preferred embodiment latched open and a bolt fully withdrawn.

If circuitry within electronics package 114 is then activated by smart card 108.then as may be seen in FIG. 9 rack 140 is driven by motorised actuator 113 against spring 135 which drives pawl 127 into engagement with dog clutch 126 overcoming captive saddle spring 127*a*. FIG. 9 shows paddle wheel 125 rotated anti-clockwise by shaft 124 driving dog clutch 126 via pawl 127 thereby lifting and disengaging retaining pin 117 from bolt 119. In FIG. 9 bolt 119 is shown in the withdrawn position. The status of bolt 119 is sensed by magnet 143 being displaced from reed switch 141 which is in an open condition. The elevated status of retaining pin 117 is sensed by the pivotal displacement of magnet 161 away from proximity with reed switch sensor 166 which is achieved by driving cooperation between drive pin 157 of retaining pin 117 which drives double crank 155 such that second slide 158 causes short magnet mounting plate 160 to pivot anti-clockwise about pivot 159.

FIG. 10 shows a 'timed-out' or idle condition with pawl 127 disengaged from dog clutch 126; lock 100 can be "woken up" from this position by rotation of handles 104*a;* 104*b*.

Figure 11:
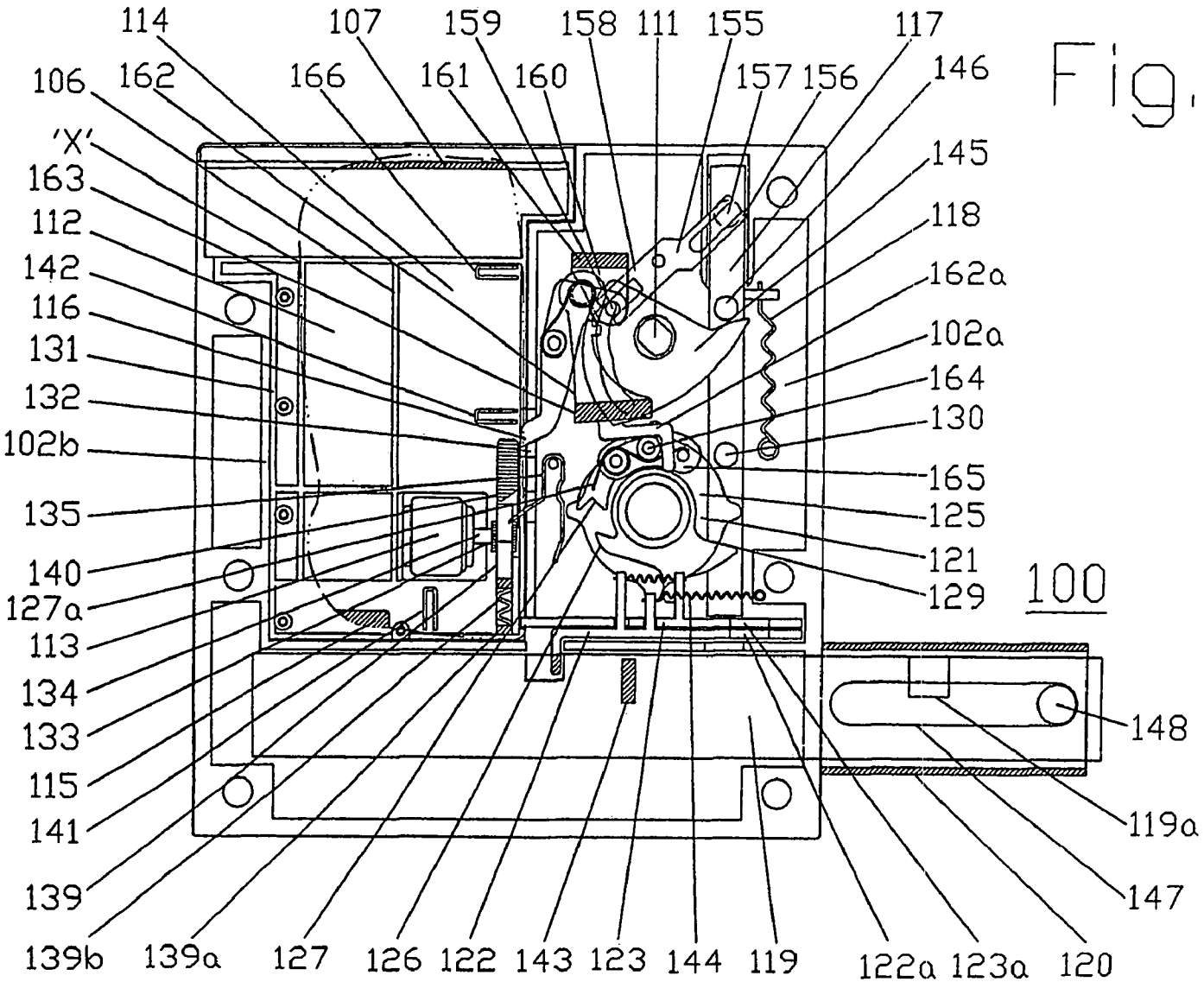
FIG. 11 shows a similar view to FIG. 9 with the lock of the second preferred embodiment latched open, in this view the lock is in mechanical override mode.

FIG. 11 shows a locked open condition. With retaining pin 117 raised, bolt 119 has been withdrawn. Racks 139 and 140 are wide open causing captive slide 139*a* of rack 139 to remain in the path of slide 123. This condition thereby prevents slides 122 and 123 from being urged out of the path of 117 with the result that slides 122 and 123 cannot present openings 122*a* and 123*a,* respectively, for retaining pin 117 to pass through.

Figure 12:
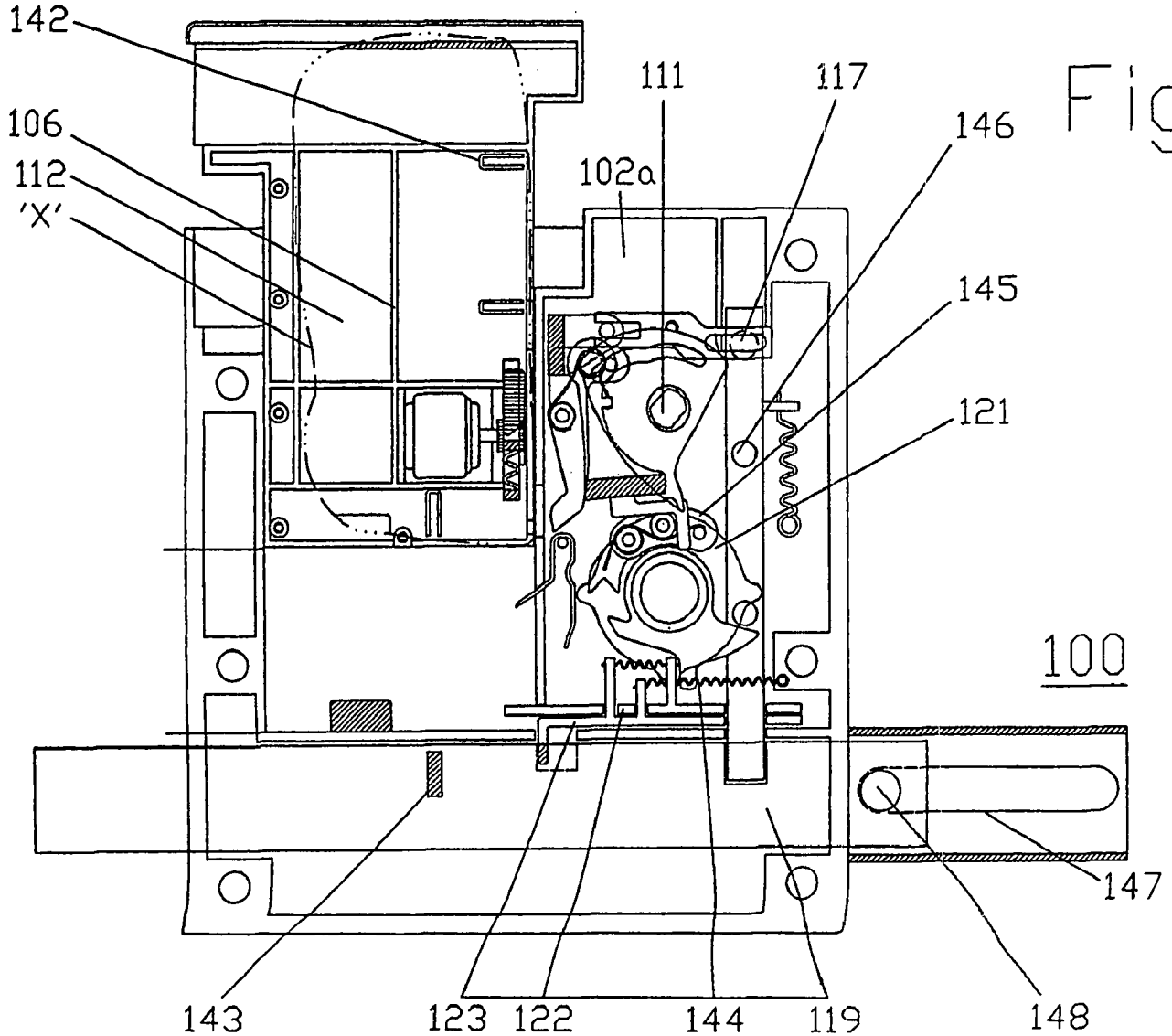
FIG. 12 shows a front elevation of the lock of the second preferred embodiment of FIGS. 1*a* and 1*b* in a locked condition with a security cover and the front lock housing removed and an electronics module partially lifted out.

FIG. 12 is analogous to FIG. 5 of the first preferred embodiment in that it shows electronics module 106 (6) in a partly removed condition with respect to secure housing 102 (2).

Although two embodiments of the present Invention have been Illustrated with reference to the accompanying figures, it will be evident to one skilled in the art that many modifications or alternative arrangements of the lock will be apparent to one skilled in the art, which alterative arrangements will be within the scope of the following claims.

The invention claimed is:

1. A lock comprising:

a secure housing having discrete first and second portions disposed apart either side of an element incorporating engaging recess means and wherein, said first portion comprises receival means for mechanical components said mechanical components providing a plurality of selectable means for independent control and operation of said lock; and said second portion comprises selectively latchable receival means for an electronics module latchably engageable with said engaging recess means of said element of said housing and selectively removable therefrom and providing means when present and functional for control and operation of said lock, and rotatable handle means external of said first portion of said secure housing selectively operatively and connectably engaged with said mechanical components of said portion of said lock said mechanical components in said first portion of the housing comprising:

a bolt, and;

a retaining pin for releasably retaining said bolt in position in said lock and a linkage mechanism for operatively connecting said rotatable handle means to said retaining pin to cause rotating movement of said rotatable handle means to displace said retaining pin, a mechanical key-operated lock;

a key for said mechanical key-operated lock;

means for selectively releasing said electronics module, said selectively removable electronics module comprises:

a power supply;

wireless transceiver and antenna means capable of receiving an authorisation signal from non-contact electronic key means; and actuator means responsive to said authorisation signal, wherein when said electronics module is present and functional within said second portion of said secure housing of said lock receipt of an authorisation signal from said non-contact key means causes said actuator means to interact with said linkage mechanism to permit rotatable movement of said rotatable handle means to displace said retaining pin, and;

wherein when said electronics module is latchably engaged within said second portion of said secure housing of said lock turning of said key for said mechanical key-operated lock for releasing said electronics module, releases said electronics module permitting said lock to be operated manually by rotatable handle means to displace said retaining pin.

2. A lock as claimed in claim 1, wherein said mechanical key-operated lock and key can also release said locking pin from said bolt to perform a manual override operation in the event of failure of said electronics module.

3. A lock as claimed in claims 1 or 2, wherein the turning of said key in said mechanical key-operated lock in a first direction releases said retaining pin from said bolt and wherein the turning of said key in a second direction releases said electronic module from said second portion of said housing.

4. A lock as claimed in claim 1, wherein said mechanical key-operated lock is arranged to receive a first key type which can only turn said mechanical key-operated lock in a first direction and a second key type which that can only turn said mechanical key-operated lock in a second opposite direction.

5. A lock as claimed in claim 1, wherein said mechanical key-operated lock is arranged to receive a key type which can turn said mechanical key-operated lock in both directions.

6. A lock as claimed in claim 1, wherein said linkage mechanism only provides a mechanical linkage between said handle means and said retaining pin when an authorisation signal has been received.

7. A lock as claimed in claim 1, further comprising a security cover plate fixed over and preventing access to a keyhole for a key for operating said mechanical key-operated lock.

8. A lock as claimed in claim 1, wherein said electronics module is normally inactivated in a sleep mode and is activated by mechanical operation of said rotatable handle means such that said antenna and transceiver means are enabled to detect the presence of said non-contact electronic key means.

9. A lock as claimed in claim 1, wherein said electronics module and said mechanical components are arranged such that an authorisation signal has to be received to permit said bolt to be locked into position by said retaining pin.

10. A lock as claimed in claim 1, wherein said electronics module comprises sensor means for detecting the presence of said bolt.

11. A lock as claimed in claim 1, wherein said electronics module is in the form of a selectively releasable cartridge.

12. A lock as claimed in claim 1, wherein said electronics module incorporates a programmable integrated circuit (PIC).

13. A lock as claimed in claim 12, wherein said cartridge is a non-functioning dummy mechanically configured such that when latchably engaged in said second portion of said secure housing of said lock said cartridge physically interacts with said mechanical components of said linkage mechanism of said first portion said lock to permit rotatable movement of said rotatable handle means to displace said retaining pin to manually release said lock.

14. A lock as claimed in claim 12, wherein said cartridge is a non-functioning dummy mechanically configured such that when latchably engaged in said second portion of said secure housing of said lock said cartridge does not interact with any of said mechanical components of said first portion of said lock thereby necessitating use of said mechanical key-operated lock and key therefor to release said lock permit rotatable movement of said rotatable handle means to displace said retaining pin to manually release said lock.

15. A lock as claimed in claim 1, wherein said electronics module incorporates a programmable application specific integrated circuit (ASIC).

16. A lock as claimed in claim 1, wherein the circuitry of said electronics module incorporates means for storing and the identity, date and time of use of each and every non-contact key means used to generate an authorisation signal to operate said lock thereby maintaining an audit trail.

17. A lock as claimed in claim 1, wherein said mechanical key-operated lock is a cylinder lock.

18. An electronics module for use with a lock, as claimed in claim 1.

19. A lock as claimed in claim 1, comprising wireless communications means for communicating with remote transceiver means.

* * * * *